United States Patent [19]

Whitfield

[11] Patent Number: 4,805,922

[45] Date of Patent: Feb. 21, 1989

[54] PUTTER

[76] Inventor: Robert L. Whitfield, 50 27th Ave., San Mateo, Calif. 94403

[21] Appl. No.: 92,639

[22] Filed: Sep. 3, 1987

[51] Int. Cl.[4] ..... A63B 53/04

[52] U.S. Cl. ..... 273/164; 273/168; 273/171; 273/173; 273/167 H

[58] Field of Search ..... 273/167 C, 175, 193 A, 273/171, 173, 164, 167 H, 167 F, 167 J, 168, 171, 169, 174

[56] References Cited

U.S. PATENT DOCUMENTS

| | | | |
|---|---|---|---|
| 3,231,281 | 1/1966 | Wallo | 273/193 A |
| 3,240,497 | 3/1966 | Taylor | 273/168 X |
| 3,637,218 | 1/1972 | Carlino | 273/167 C |
| 4,067,572 | 1/1978 | Coleman | 273/175 |

FOREIGN PATENT DOCUMENTS

| | | | |
|---|---|---|---|
| 713954 | 7/1965 | Canada | 273/167 C |

*Primary Examiner*—George J. Marlo
*Attorney, Agent, or Firm*—Julian Caplan

[57] ABSTRACT

A hollow, double-faced mallet-shaped putter is made from a plug and a cap into which the plug fits. A handle is inserted through the body of the cap. In one embodiment the cap may be fabricated from a pipe cap, the peripheral flange being removed and the exterior machined cylindrical, and a pipe cap threaded therein, the wrench grip of the plug being removed after insertion. Both ends of the putter are machined flat and perpendicular to the central axis of the club head.

6 Claims, 1 Drawing Sheet

PUTTER

BACKGROUND OF THE INVENTION

1. Field of the Invention

This invention relates to a new and improved putter and more particularly relates to a mallet-type putter having a cylindrical body with opposed ends, either of which may be used to stroke a golf ball.

2. Description of Related Art

Mallet-type putters are old in the art. The present invention is distinguishable from prior putters of this type in that the head of the club is fabricated from two pieces, one resembling a pipe cap and the other a pipe plug, the outer face of the end of the cap and the outer face of the plug comprising the alternate surfaces which may be used to stroke the ball.

SUMMARY OF THE INVENTION

The head of the club is formed of a first part resembling a pipe cap with a cylindrical exterior having one end perpendicular to the axis of the cap. The opposite end of the cap is filled with a second part resembling a pipe plug which also has an exterior perpendicular to the axis of the cap. The handle fits through the side of the cap perpendicular to the axis thereof and is suitably secured to the interior of the cap as well as to the exterior.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 3:
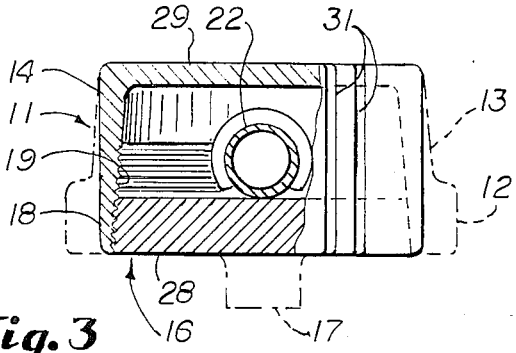
FIG. 3 is a sectional view taken substantially along the line 3—3 of FIG. 2 and partially broken away to show internal construction.

As best shown in FIG. 3, the head of the club is formed of a cap 11, such as a pipe cap. A conventional pipe cap may have a peripheral flange 12 and generally has a tapered frusto-conical exterior 13. Preliminary to assembly, the cap 11 is machined to remove the flange 12 and to make the exterior 14 cylindrical. End 29 is machined flat and perpendicular to the axis of the cap.

A plug 16 having external threads 18 fits into the internal threads 19 of cap 11. Plug 16 originally may have been a conventional pipe plug having a wrench grip 17 which is machined away after assembly of the parts and the exterior end 28 is machined flat and perpendicular to the axis of the cap.

A hole 21 is drilled into the side of cylindrical exterior 14 in a direction perpendicular to the central axis of the cap 11. Handle 22 fits through the hole 21 and extends internally to the opposite side of the cap to which it is attached by brazing, soldering, welding or the like 23. Brazing, soldering, welding or the like 24 on the exterior of cap 11 likewise secures the handle 22 in position. The handle 22 may be of any conventional putter handle construction, preferably hollow tubing to which a grip 26 is attached at the end opposite the putter head.

The exterior faces 28 of the plug 16 and 29 of the cap 11 are surfaced approximately planar for accurate stroking of the ball. Alignment grooves 31 may be inscribed longitudinally of the surface 14 to either side of handle 22 to assist the player in lining up the club with the ball.

Figure 1:
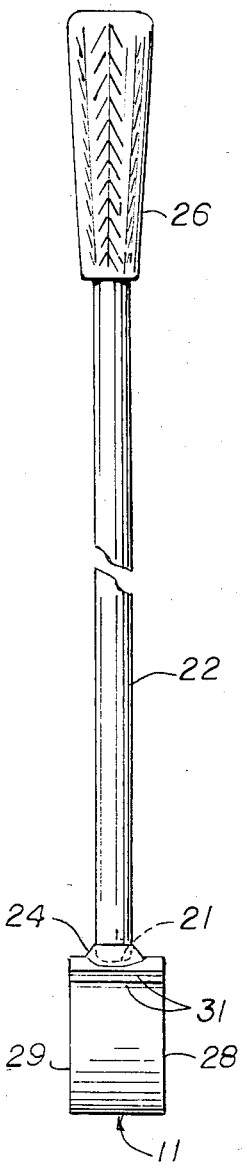
FIG. 1 is a side elevational view of a putter in accordance with the present invention.
Figure 2:
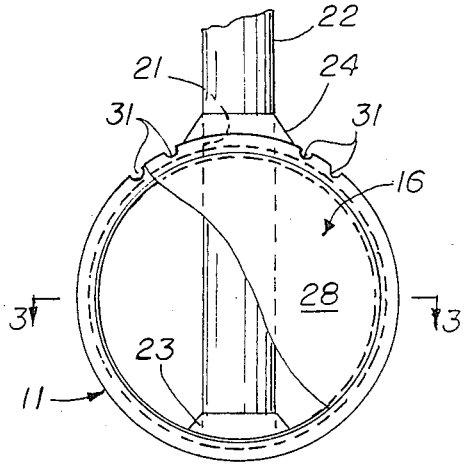
FIG. 2 is an enlarged fragmentary end view thereof partially broken away to reveal internal construction.
Figure 4:
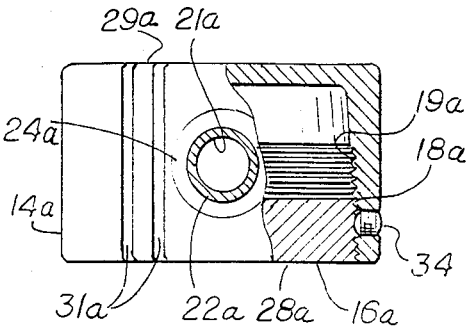
FIG. 4 is a fragmentary view showing a modification.

In the form of the invention shown in FIGS. 1-3, the plug 16 may be secured into the cap 11 by pipe dope (not shown) such as the commercially available "Locktite" pipe compound. In the modification shown in FIG. 4, an Allen head screw 14 functioning as a set screw holds the plug **16*a* tight in the cap 11*a*. In other respects the modification of FIG. 4** resembles that of the preceding modification and the same reference numerals followed by the subscript a are used to designate corresponding parts.

The shaft of handle 22 may be made of various conventional materials used in golf clubs such as aluminum or tempered stainless steel. The plug 16 and cap 11 may be of aluminum or bronze, as well as chrome plated iron or steel or stainless steel. The plug 16 may be of the same materials as the cap 11 or of a contrasting material. For example, the cap 11 may be of bronze, while the plug 16 is of aluminum.

The invention has been described as being fabricated from pipe caps and pipe plugs. However, it will be understood that the plug might be machined from conventional round stock.

What is claimed is:

1. A golf putter having a handle and a hollow, mallet-type, two-piece head attached to said handle, said head comprising a hollow first portion having an elongated cylindrical exterior, an external first end integral with said first portion having a first face perpendicular to the longitudinal axis of said first portion and an open second end opposite said first end; a plug second portion fitting into said open second end having an external second face perpendicular to said axis; cooperating first means on said first portion and said plug portion securing the same together; and second means fixing said handle to said head, said cooperating first means comprising internal threads on said first portion inward of said first end and external threads on said plug second portion mating with said internal threads.

2. A putter according to claim 1 which further comprises a set screw threaded through said first portion engaging said plug second portion.

3. A putter according to claim 1 in which a hole is formed in said cylindrical exterior through which said handle fits in a direction perpendicular to the central axis of said first portion.

4. A putter according to claim 3 in which said handle extends into said first portion to a location in the interior of said first portion opposite said hole and in which said second means comprises means in the interior of said first portion adjacent said location attaching the inner end of said handle to the interior of said first portion.

5. A putter according to claim 4 in which said second means further comprises second means on the exterior of said cap portion vicinal said hole.

6. A putter according to claim 5 in which said cylindrical exterior is formed with longitudinally extending alignment grooves parallel to the longitudinal axis thereof and adjacent said hole.

* * * * *